US010423091B2

(12) United States Patent
Tominaga

(10) Patent No.: US 10,423,091 B2
(45) Date of Patent: Sep. 24, 2019

(54) IMAGE FORMING APPARATUS FOR SUPPRESSING DEGRADATION IN IMAGE QUALITY

(71) Applicant: FUJI XEROX CO., LTD., Tokyo (JP)

(72) Inventor: Yoshiyuki Tominaga, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/943,948

(22) Filed: Apr. 3, 2018

(65) Prior Publication Data

US 2019/0094736 A1 Mar. 28, 2019

(30) Foreign Application Priority Data

Sep. 27, 2017 (JP) ..... 2017-187103

(51) Int. Cl.
*G03G 15/01* (2006.01)
*G03G 15/16* (2006.01)
*G03G 15/00* (2006.01)

(52) U.S. Cl.
CPC ..... *G03G 15/0131* (2013.01); *G03G 15/0189* (2013.01); *G03G 15/1605* (2013.01); *G03G 15/6585* (2013.01); *G03G 2215/1623* (2013.01)

(58) Field of Classification Search
CPC ..... G03G 15/0131; G03G 15/1605; G03G 2215/1623
USPC ..... 399/302
See application file for complete search history.

(56) References Cited

U.S. PATENT DOCUMENTS

| | | | | |
|---|---|---|---|---|
| 9,547,249 | B2 * | 1/2017 | Kochi | G03G 15/0131 |
| 9,772,575 | B1 * | 9/2017 | Yamaura | G03G 15/1605 |
| 2013/0251431 | A1 * | 9/2013 | Numao | G03G 15/6585 399/341 |
| 2015/0370206 | A1 * | 12/2015 | Hitosugi | G03G 15/6585 399/53 |
| 2016/0378009 | A1 * | 12/2016 | Nakai | G03G 15/0131 399/223 |

FOREIGN PATENT DOCUMENTS

| | | | |
|---|---|---|---|
| JP | 2013037019 A | * | 2/2013 |
| JP | 2015-064401 A | | 4/2015 |
| JP | 2015-206951 A | | 11/2015 |

* cited by examiner

*Primary Examiner* — Susan S Lee
(74) *Attorney, Agent, or Firm* — Sughrue Mion, PLLC

(57) ABSTRACT

An image forming apparatus includes: a first image forming unit that forms an image by using first toner; a second image forming unit that forms an image by using another kind of toner different from the first toner; a transfer unit that transfers the images formed by the first image forming unit and the second image forming unit onto an intermediate transfer body and then onto a recording medium; and a setting unit that sets an order of the images that are transferred onto the intermediate transfer body so that the image formed from the other kind of toner is transferred onto an independent image formed from the first toner transferred onto the intermediate transfer body in a case where the independent image formed from the first toner is to be formed on the recording medium.

20 Claims, 14 Drawing Sheets

IMAGE FORMING APPARATUS FOR SUPPRESSING DEGRADATION IN IMAGE QUALITY

CROSS-REFERENCE TO RELATED APPLICATIONS

This application is based on and claims priority under 35 USC 119 from Japanese Patent Application No. 2017-187103 filed Sep. 27, 2017.

BACKGROUND

Technical Field

The present invention relates to an image forming apparatus.

SUMMARY

According to an aspect of the invention, there is provided an image forming apparatus including: a first image forming unit that forms an image by using first toner; a second image forming unit that forms an image by using another kind of toner different from the first toner; a transfer unit that transfers the images formed by the first image forming unit and the second image forming unit onto an intermediate transfer body and then onto a recording medium; and a setting unit that sets an order of the images that are transferred onto the intermediate transfer body so that the image formed from the other kind of toner is transferred onto an independent image formed from the first toner transferred onto the intermediate transfer body in a case where the independent image formed from the first toner is to be formed on the recording medium.

BRIEF DESCRIPTION OF THE DRAWINGS

Exemplary embodiments of the present invention will be described in detail based on the following figures, wherein.

DETAILED DESCRIPTION

Exemplary embodiments of the present invention are described below with reference to the drawings.

First Exemplary Embodiment

Figure 1:
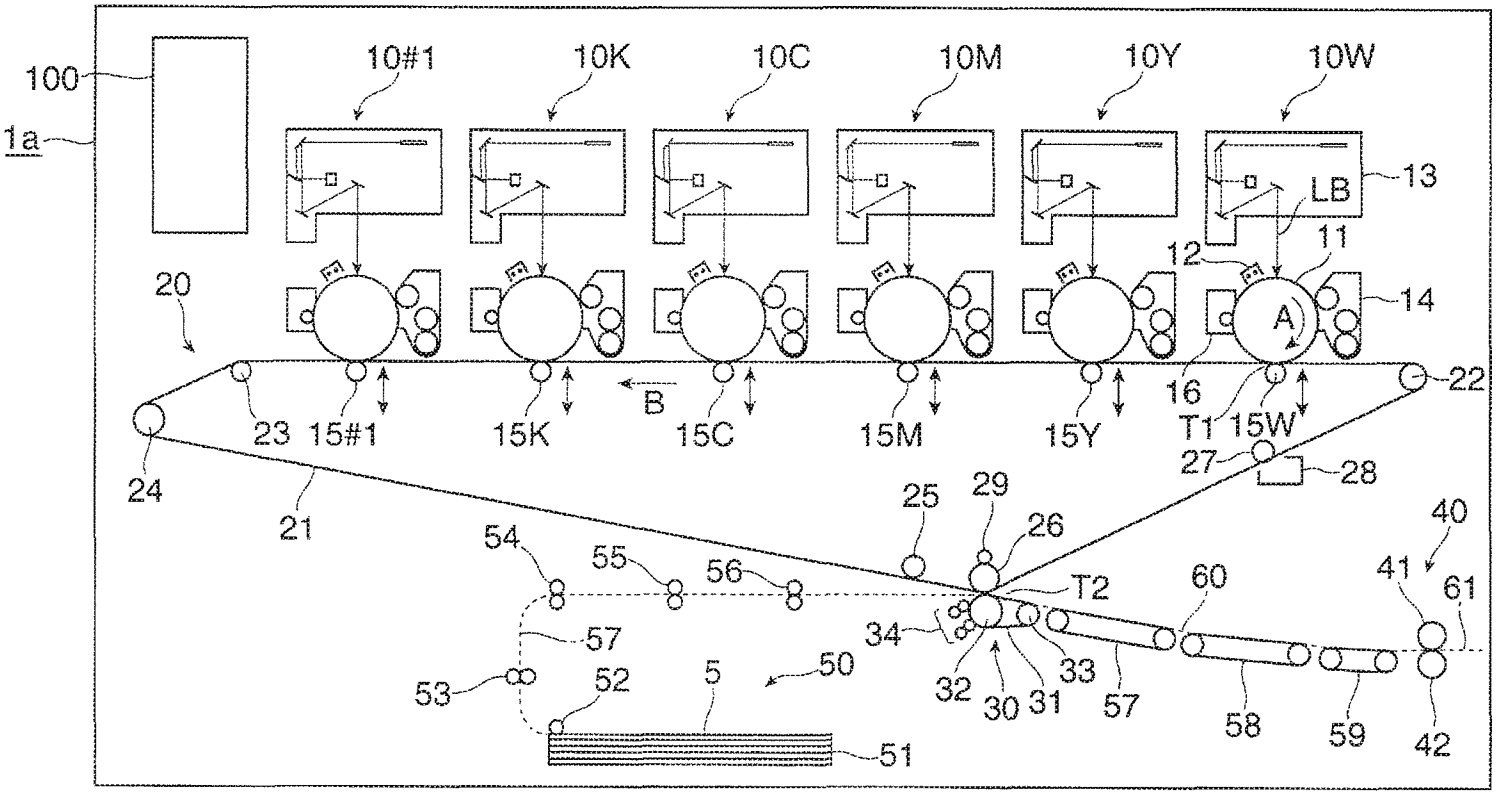
FIG. 1 schematically illustrates a configuration of an image forming apparatus according to a first exemplary embodiment of the present invention.
Figure 2:
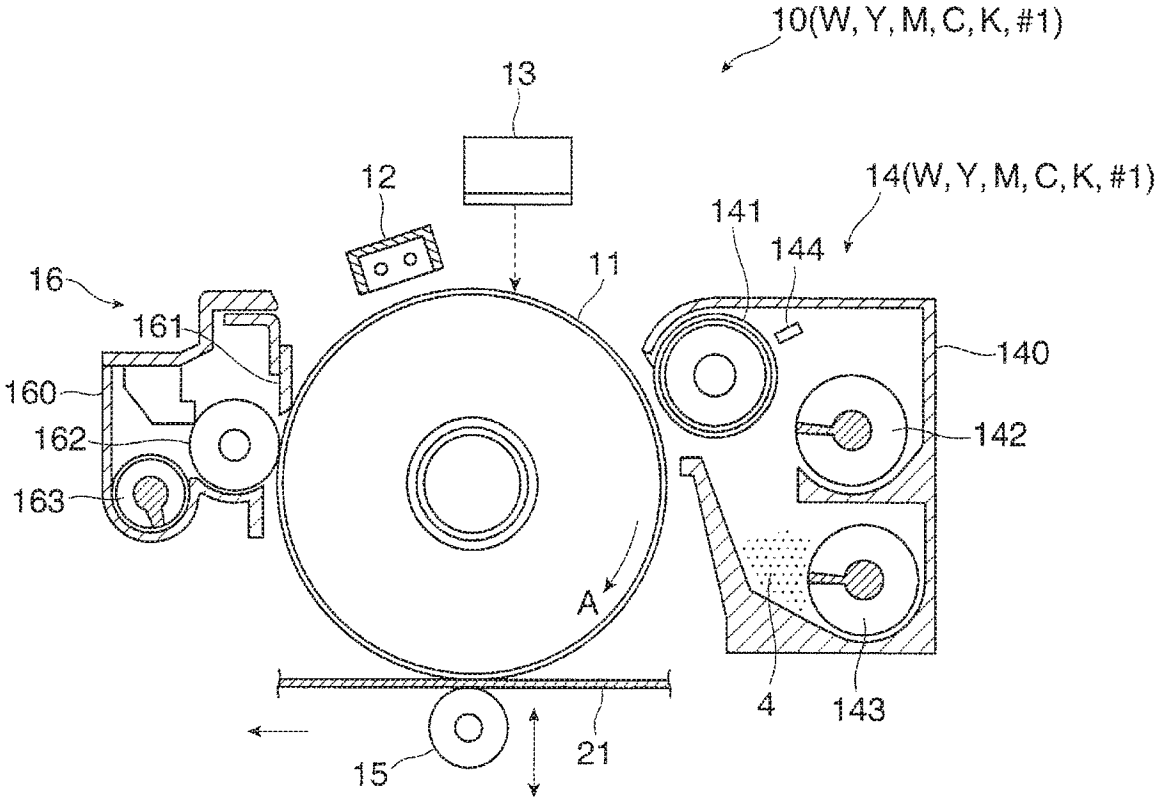
FIG. 2 illustrates a configuration of an image forming unit of the image forming apparatus according to the first exemplary embodiment of the present invention.

FIGS. 1 and 2 illustrate an image forming apparatus according to a first exemplary embodiment. FIG. 1 illustrates an outline of the whole image forming apparatus, and FIG. 2 is an enlarged view of a substantial part (an image preparing device and other members) of the image forming apparatus.

Overall Configuration of Image Forming Apparatus

An image forming apparatus 1 according to the first exemplary embodiment is, for example, a color printer. The image forming apparatus 1 includes plural image preparing devices 10 that are examples of first and second image forming units that form toner images developed with the use of toner that constitutes a developer 4, an intermediate transfer device 20 that is an example of a transfer unit that holds and transfers the toner images formed by the image preparing devices 10 to a second transfer position T2 at which the toner images are finally second-transferred onto recording paper 5 that is an example of a recording medium, a paper feed device 50 that contains and transports necessary recording paper 5 to be fed to the second transfer position T2 of the intermediate transfer device 20, a fixing device 40 that fixes the toner images second-transferred onto the recording paper 5 by the intermediate transfer device 20, and the like. The image forming apparatus 1 illustrated in FIG. 1 has a body 1*a* that is constituted by members such as a support structure member and an exterior cover. The broken line in FIG. 1 indicates a path on which the recording paper 5 is transported inside the body 1*a*.

The image preparing devices 10 include six image preparing devices 10W, 10Y, 10M, 10C, 10K, and 10#1 that are exclusively for formation of toner images of six colors, i.e., white (W), yellow (Y), magenta (M), cyan (C), black (K), and a spot color (#1), respectively. These six image preparing devices 10 (W, Y, M, C, K, and #1) are aligned along a horizontal direction inside the body 1*a*. Among the six image preparing devices 10 (W, Y, M, C, K, and #1), the image preparing device 10W that forms an image by using white (W) toner that is an example of first toner constitutes the first image forming unit, and five image preparing devices 10 (Y, M, C, K, and #1) other than the image preparing device 10W for white (W) constitute the second image forming unit. In this exemplary embodiment, the image preparing device 10W for white (W) is disposed on a most upstream side in a direction in which a second transfer belt 21 moves. In this exemplary embodiment, the image preparing device 10#1 for the spot color (#1) is disposed on a most downstream side along the direction in which the second transfer belt 21 moves. The image preparing devices 10 (Y, M, C, and K) that form full-color images of yellow (Y), magenta (M), cyan (C), and black (K) are disposed between the image preparing device 10W for white (W) and the image preparing device 10#1 for the spot color (#1).

A color of a toner image formed by the image preparing device 10#1 for the spot color (#1) is not limited in particular, and any toner such as toner of a metallic color such as gold or silver, transparent toner, or foamed toner may be used. Furthermore, the color of the toner image formed by the image preparing device 10#1 for the spot color (#1) may be white (W). In this case, a second image preparing device 10W for white (W) disposed on a most downstream side is provided in addition to a first image preparing device 10W for white (W) disposed on a most upstream side in the direction in which the intermediate transfer belt 21 moves. In this first exemplary embodiment, transparent toner is used in the image preparing device 10#1 for the spot color (#1).

As illustrated in FIGS. 1 and 2, each of the image preparing devices 10 (W, Y, M, C, K, and #1) includes a photoconductor drum 11 that is an example of a rotating image carrier, and the following devices are disposed around the photoconductor drum 11. Such devices include a charging device 12 that charges a circumferential surface (an image carrying surface) of the photoconductor drum 11 on which an image can be formed to a necessary potential, an exposure device 13 that is an example of an exposure unit that forms an electrostatic latent image (for a corresponding color) having a potential difference by irradiating the charged circumferential surface of the photoconductor drum 11 with light based on information (a signal) of an image, a developing device 14 (W, Y, M, C, K, or #1) that is an example of a developing unit that creates a toner image by developing the electrostatic latent image by using toner of the developer 4 of the corresponding color (W, Y, M, C, K, or #1), a first transfer device 15 that is an example of a first transfer unit that transfers the toner image onto the intermediate transfer device 20, and a drum cleaning device 16 that cleans the image carrying surface of the photoconductor drum 11 after the first transfer by removing an attached substance such as toner remaining on the image carrying surface.

The photoconductor drum 11 is obtained by forming the image carrying surface having a photoconductive layer (photosensitive layer) made of a photosensitive material on a circumferential surface of a cylindrical or columnar base member that is grounded. This photoconductor drum 11 is supported so as to rotate in a direction indicated by arrow A upon receipt of driving force transmitted from a driving device (not illustrated).

The charging device 12 is a non-contact-type charging device such as a corona discharger disposed so as not to be in contact with the photoconductor drum 11. A charge voltage is supplied to the charging device 12. A voltage or an electric current of the same polarity as a charge polarity of toner fed from the developing device 14 is supplied as the charge voltage in a case where the developing device 14 is for reversal development. Note that a contact-type charging device such as a charging roller disposed in contact with the photoconductor drum 11 may be used as the charging device 12.

The exposure device 13 forms an electrostatic latent image by irradiating the charged circumferential surface of the photoconductor drum 11 with laser light LB based on information on an image input to the image forming apparatus 1. At a time of formation of the latent image, the exposure device 13 receives the information (signal) on the image that is input to the image forming apparatus 1 by using any means. The exposure device 13 may be an LED print head that forms an electrostatic latent image by irradiating the photoconductor drum 11 with light emitted from plural LEDs that are light-emitting elements aligned along an axial direction of the photoconductor drum 11.

As illustrated in FIG. 2, each of the developing devices 14 (W, Y, M, C, K, and #1) is arranged such that members such as a development roller 141 that holds the developer 4 and transports the developer 4 to a developing region facing the photoconductor drum 11, stirring transporting members 142 and 143 such as screw augers that stir and transport the developer 4 so that the developer 4 passes the development roller 141, and a layer thickness regulating member 144 that regulates an amount (layer thickness) held by the development roller 141 are disposed in a housing 140 having an opening and a container chamber in which the developer 4 is contained. A developing voltage is supplied between the development roller 141 and the photoconductor drum 11 to the developing device 14 from the power source device (not illustrated). The development roller 141 and the stirring transporting members 142 and 143 rotate in a necessary direction upon receipt of driving force transmitted from a driving device (not illustrated). Furthermore, a two-component developer containing non-magnetic toner and magnetic toner is used as each of the developers 4 (W, Y, M, C, K, and #1) for the six colors. Each of the developing devices 14 (W, Y, M, C, K, and #1) includes a toner concentration detecting unit (not illustrated) that detects a toner concentration of the developer 4 in the housing 140.

Figure 3A:
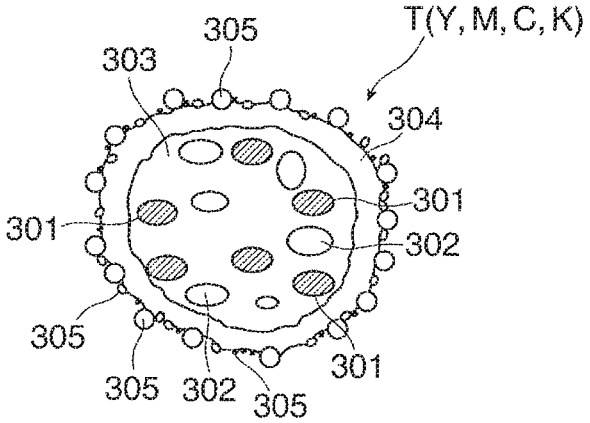
FIGS. 3A and 3B are cross-sectional views schematically illustrating full-color toner and white toner.

As illustrated in FIG. 3A, toner T (Y, M, C, and K) of respective colors of yellow (Y), magenta (M), cyan (C), and black (K) is, for example, toner including a general heat melting resin 303 in which a color material particle 301 and a synthetic resin 302 having a low melting point, wax, or the like are dispersed, a general heat melting resin 304 coating an outer circumference of the heat melting resin 303, and an external additive 305 that is added to an external circumferential surface of the heat melting resin 304 and is constituted by a functional fine particle for adjusting charging performance and cleaning performance. A number average particle diameter of the color toner T (Y, M, C, and K) is set, for example, to approximately 4 μm to 6 μm.

Figure 3B:
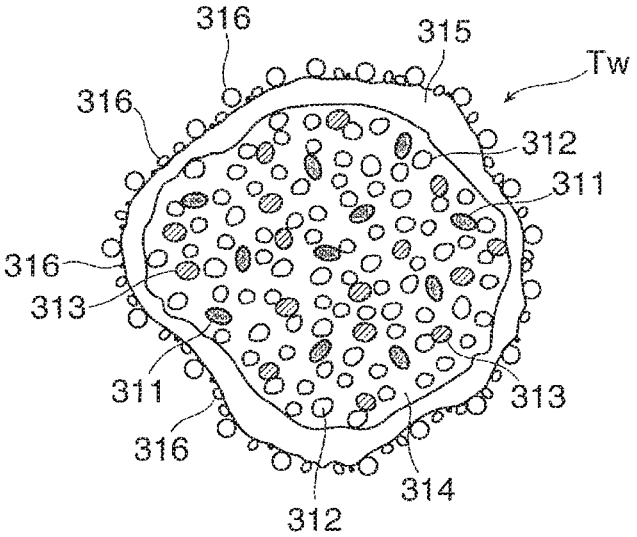

Meanwhile, as illustrated in FIG. 3B, white toner $T_W$ is, for example, toner including a general heat melting resin 313 in which a white metal pigment particle 311 such as $TiO_2$ and a crystalline resin 312, wax, or the like are dispersed or a general heat melting resin 314, a general heat melting resin 315 coating an outer circumference of the heat melting resin 313 or the heat melting resin 314, and an external additive 316 that is added to an outer circumferential surface of the heat melting resin 315 and is constituted by a functional fine particle for adjusting charging performance and cleaning performance. A particle diameter of the white toner $T_W$ is set larger than that of the general toner T (Y, M, C, and K) of yellow (Y), magenta (M), cyan (C), and black (K). A number average particle diameter of the white toner $T_W$ is set, for example, to approximately 7 μm to 9 μm. Because of the presence of the white metal pigment particle 311 such as $TiO_2$, the white toner $T_W$ has a higher dielectric loss factor and a lower dielectric characteristic than the general toner T (Y, M, C, and K) and therefore tends to generate an image defect such as toner scattering that occurs depending on a charge amount.

Transparent toner $T_C$ used as spot color toner is made up of components similar to the color toner illustrated in FIG. 3A except for that the transparent toner $T_C$ does not include the color material 301. A number average particle diameter of the transparent toner $T_C$ is set, for example, to approximately 6 μm.

Note that a similar magnetic carrier is used in the general toner T (Y, M, C, and K) of yellow (Y), magenta (M), cyan (C), and black (K), the white toner $T_W$, and the spot color toner.

As illustrated in FIGS. 1 and 2, the first transfer device 15 is a contact-type transfer device including a first transfer roller that rotates in contact with the circumferential surface of the photoconductor drum 11 with the intermediate transfer belt 21 interposed therebetween at the first transfer position T1 and that receives a voltage for first transfer. As the voltage for first transfer, direct-current voltage of a polarity opposite to a charge polarity of toner is supplied from the power source device (not illustrated).

Each of the first transfer devices 15 (W, Y, M, C, K, and #1) is, for example, configured to be capable of making contact with and being separated from the intermediate transfer belt 21 at the first transfer position T1 by a contact separation unit (not illustrated) for each of the image preparing devices 10 (W, Y, M, C, K, and #1). Note that each of the first transfer devices 15 (W, Y, M, C, K, and #1) may be always in contact with the intermediate transfer belt 21 at the first transfer position T1.

As illustrated in FIG. 2, the drum cleaning device 16 is constituted by a cleaning plate 161 that is disposed inside a container-shaped body 160 and does cleaning by removing an attached substance such as remaining toner, a cleaning brush 162 that does cleaning by removing the attached substance such as remaining toner, a delivering member 163 such as a screw auger that collects the attached substance such as toner removed by the cleaning plate 161 and the cleaning brush 162 and delivers the collected attached substance to a collecting system (not illustrated), and the like. The cleaning plate 161 is a plate-shaped member (e.g., a blade) made of a material such as rubber.

As illustrated in FIG. 1, the intermediate transfer device 20 is disposed below the image preparing devices 10 (W, Y, M, C, K, and #1). The intermediate transfer device 20 is constituted by an intermediate transfer belt 21 that is an example of an intermediate transfer body that circulates in a direction indicated by arrow B while passing the first transfer position T1 between the photoconductor drum 11 and the first transfer device 15 (a first transfer roller), plural belt support rollers 22 to 27 that support the intermediate transfer belt 21 so that the intermediate transfer belt 21 can circulate by holding the intermediate transfer belt 21 in a desired state from an inner circumference of the intermediate transfer belt 21, a second transfer device 30 that is disposed on an outer circumferential surface (image carrying surface) side of the intermediate transfer belt 21 supported by the belt support roller 26 and second-transfers a toner image on the intermediate transfer belt 21 onto the recording paper 5, and a belt cleaning device 28 that cleans the outer circumferential surface of the intermediate transfer belt 21 that has passed the second transfer device 30 by removing an attached substance such as toner and paper powder remaining on the outer circumferential surface of the intermediate transfer belt 21.

The intermediate transfer belt 21 is, for example, an endless belt made of a material obtained by dispersing an agent such as a resistance controlling agent (e.g., carbon black) in a synthetic resin such as a polyimide resin or a polyamide resin. The belt support roller 22 serves as a driving roller, the belt support rollers 23 and 25 serve as driven rollers that hold a travelling position and the like of the intermediate transfer belt 21, the belt support roller 24 serves as a tension applying roller, the belt support roller 26 serves as a backup roller for second transfer, and the belt support roller 27 serves as a support roller for the belt cleaning device 28.

As illustrated in FIG. 1, the second transfer device 30 serves as a second transfer belt device that rotates at a second transfer position T2 that is an outer circumferential surface part of the intermediate transfer belt 21 supported by the belt support roller 26 in the intermediate transfer device 20. The second transfer device 30 includes a second transfer belt 31, plural belt support rollers 32 and 33 that support the second transfer belt 31, and a belt cleaning device 34 that cleans the second transfer belt 31. Of the plural belt support rollers 32 and 33, the belt support roller 32 serves as a second transfer roller. A bias application roller 29 illustrated in FIG. 1 applies a second-transfer bias voltage to the belt support roller 26.

The fixing device 40 includes a roller-shaped or belt-shaped rotating body for heating 41 that is heated by a heating unit (heat source) so that a surface temperature thereof is held at a predetermined temperature, a roller-shaped or belt-shaped rotating body for pressurizing 42 that rotates in contact with the rotating body for heating 41 by necessary pressure, and the like. In this fixing device 40, a part where the rotating body for heating 41 and the rotating body for pressurizing 42 make contact with each other serves as a fixing unit for necessary fixing processing (heating and pressurizing).

The paper feed device 50 is disposed below the intermediate transfer device 20. The paper feed device 50 is constituted by a single or plural paper container(s) 51 in which sheets of recording paper 5 of desired size, kind, and the like are stacked and a delivering device 52 that delivers the sheets of recording paper 5 out of the paper container 51 one by one. The paper container 51 is, for example, attached so that the paper container 51 can be drawn out on a front (a side surface which an operating user faces) side of the body 1*a*.

The recording medium 5 is, for example, thin paper such as plain paper or tracing paper used for an electrophotographic copying machine, printer, or the like or an OHP sheet or the like (hereinafter referred to as a "film medium") that is a transparent film-shaped medium made of a synthetic resin (e.g., PET). In order to further improve smoothness of an image surface after fixation, it is preferable that a surface of the recording paper 5 also be as smooth as possible. For example, coat paper obtained by coating a surface of plain paper with a resin or the like, thick paper, such as art paper for printing, having a relatively large basis weight, or the like can be suitably used.

A paper feed transport path 57 constituted by a single (or plural) sheet transport roller pair(s) 53 to 56 that transport(s) the recording paper 5 delivered out of the paper feed device 50 to the second transfer position T2 and a transport guide member (not illustrated) is provided between the paper feed device 50 and the second transfer device 30. The sheet transport roller pair 56 disposed at a position immediately before the second transfer position T2 on the paper feed transport path 57 serves, for example, as a roller (resist roller) that adjusts a timing of transport of the recording paper 5.

A sheet transport path 60 constituted by plural (or a single) sheet transfer belt(s) 57, 58, and 59 that transport the recording paper 5 delivered from the second transfer device 30 to the fixing device 40 is provided between the second transfer device 30 and the fixing device 40.

A sheet discharge transport path 61 that includes a sheet discharge roller (not illustrated) for discharging the recording paper 5 onto which a toner image has been fixed by the fixing device 40 to a paper discharge unit (not illustrated) disposed on a side face of the body 1*a* is provided on a downstream side of the fixing device 40.

A control device 100 illustrated in FIG. 1 is an example of a controller that collectively controls an operation of the image forming apparatus 1. The control device 100 includes a central processing unit (CPU), a read only memory (ROM), a random access memory (RAM), a bus connecting these members such as the CPU and the ROM, and a communication interface, each of which is not illustrated.

Basic Operation of Image Forming Apparatus

A basis image forming operation of the image forming apparatus 1 is described below.

The following describes an image forming operation for forming a full-color image that is a combination of toner images of four colors (Y, M, C, and K) by using the four image preparing devices 10 (Y, M, C, and K) among the six image preparing devices 10 (W, Y, M, C, K, and #1). An image forming operation for forming an image by appropriately combining toner images formed from white toner and spot color toner with the full-color image is basically similar to this image forming operation.

Upon receipt of command information requesting an image forming operation (print), the image forming apparatus 1 activates the four image preparing devices 10 (Y, M, C, and K), the intermediate transfer device 20, the second transfer device 30, the fixing device 40, and the like under control of the control device 100. In the image preparing devices 10 that do not perform the image forming operation, the first transfer device 15 is moved away from the intermediate transfer belt 21, but the photoconductor drum 11 is driven to rotate.

In each of the image preparing devices 10 (Y, M, C, and K), first, the photoconductor drum 11 rotates in a direction indicated by arrow A, and then the charging device 12 changes the surface of the photoconductor drum 11 to necessary polarity (a negative polarity in the first exemplary embodiment) and potential. Next, the exposure device 13 forms an electrostatic latent image of a corresponding color component (Y, M, C, or K) created by a necessary potential difference on the charged surface of the photoconductor drum 11 by irradiating the charged surface of the photoconductor drum 11 with light based on a signal of an image obtained by converting information on the image input to the image forming apparatus 1 into the color component (Y, M, C, or K).

Next, the developing device 14 (Y, M, C, or K) develops the electrostatic latent image of the corresponding color component formed on the photoconductor drum 11 by supplying and electrostatically attaching toner of the corresponding color (Y, M, C, or K) charged to the necessary polarity (the negative polarity). As a result of this development, the electrostatic latent image of the corresponding color component formed on the photoconductor drum 11 is rendered visible as a toner image of the corresponding one of the four colors (Y, M, C, and K) developed by using toner of the corresponding color.

Next, when the toner images of the respective colors formed on the photoconductor drums 11 of the image preparing devices 10 (Y, M, C, and K) are transported to the first transfer positions T1, the first transfer devices 15 sequentially first-transfer the toner images onto the intermediate transfer belt 21 rotating in the direction indicated by arrow B of the intermediate transfer device 20 so that the toner images overlap one another.

In each of the image preparing devices 10 that has completed the first transfer, the drum cleaning device 16 cleans the surface of the photoconductor drum 11 by scraping an attached substance away. This makes each of the image preparing devices 10 ready for a next image preparing operation.

Next, in the intermediate transfer device 20, the toner images thus first-transferred are held and transported to the second transfer position T2 by rotation of the intermediate transfer belt 21. In the paper feed device 50, the necessary recording paper 5 is delivered to the paper feed transport path 57 in accordance with the image preparing operation. On the paper feed transport path 57, the sheet transport roller pair 56 serving as a resist roller delivers the recording paper 5 to the second transfer position T2 in accordance with a transfer timing.

At the second transfer position T2, the second transfer roller 32 collectively second-transfers the toner images on the intermediate transfer belt 21 onto the recording paper 5. In the intermediate transfer device 20 that has completed the second transfer, the belt cleaning device 28 cleans the surface of the intermediate transfer belt 21 by removing an attached substance such as toner remaining on the surface of the intermediate transfer belt 21 after the second transfer.

Next, the recording paper 5 onto which the toner images have been second-transferred is peeled off from the intermediate transfer belt 21 and the second transfer belt 31 and is then transported to the fixing device 40 by three consecutive transport belts 57, 58, and 59. In the fixing device 40, the recording paper 5 after the second transfer is introduced so as to pass the part where the rotating body for heating 41 and the rotating body for pressurizing 42 that are rotating make contact each other, and thus the unfixed toner images are fixed onto the recording paper 5 by necessary fixing processing (heating and pressurizing). The recording paper 5 after fixing is discharged to a discharge container (not illustrated) provided, for example, on a side face of the image forming apparatus 1 by the sheet discharge roller (not illustrated) through the sheet discharge transport path 61.

Figure 4A:
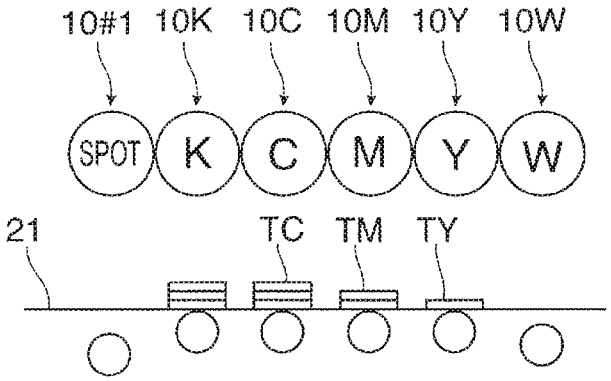
FIGS. 4A through 4C schematically illustrate a basic image forming operation in the image forming apparatus according to the first exemplary embodiment of the present invention.

Through the above operation, a full-color image that is a combination of the toner images formed from toner T of the four colors (Y, M, C, and K) is first-transferred as multiple layers onto the intermediate transfer belt 21 as illustrated in FIG. 4A. As described above, an image obtained by appropriately combining toner images formed from white toner and spot color toner with a full-color image is also first-transferred as multiple layers onto the intermediate transfer belt 21 through a similar image forming operation.

Figure 4B:
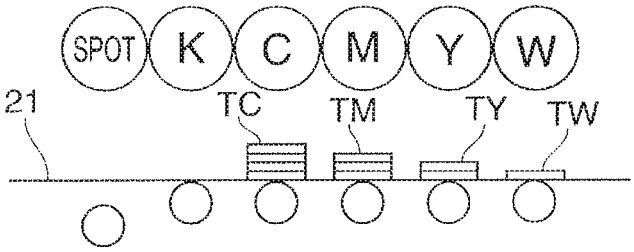

In the image forming apparatus 1, in a case where an image is formed by combining a toner image formed from white toner with a full-color image, a toner image formed from white toner $T_W$ is formed by the image preparing device 10W for white (W), and then toner images formed from full-color toner T (Y, M, C, and K) formed by the image preparing devices 10 for yellow (Y), magenta (M), cyan (C), and black (K) (Y, M, C, and K) are first-transferred as multiple layers onto the intermediate transfer belt 21, as illustrated in FIG. 4B. In FIG. 4B, for convenience of illustration, a state where the toner image formed from the white toner $T_W$ and the full-color toner T (Y, M, and C) overlap is illustrated, but the toner image formed from the white toner $T_W$ is generally formed as an independent image without overlapping the full-color toner T (Y, M, and C).

Figure 4C:
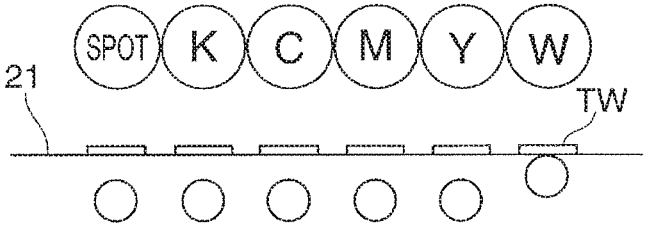

In the image forming apparatus 1, in a case where an image formed from white toner is formed, basically, a toner image formed from white toner is formed by the image preparing device 10W for white (W), and then the intermediate transfer belt 21 onto which the toner image formed from the white toner has been first-transferred passes without transfer of toner images from the image preparing devices 10 (Y, M, C, K, and #1) of yellow (Y), magenta (M), cyan (C), black (K), and spot color (#1), as illustrated in FIG. 4C.

Figure 5A:
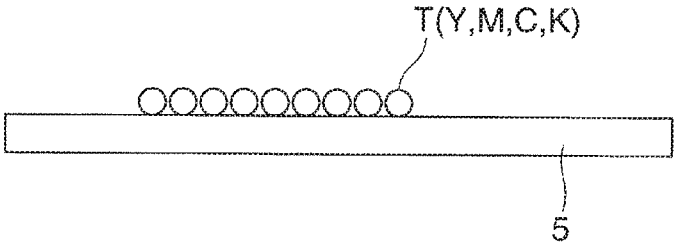
FIGS. 5A and 5B schematically illustrate a toner image formed on a recording medium.
Figure 5B:
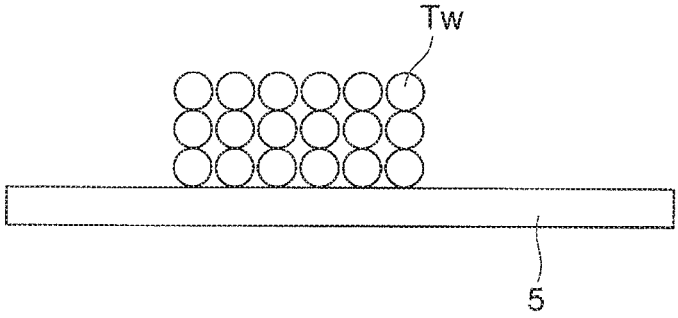

In a case where an image formed from white toner is formed on the recording paper 5, an image density of the white toner image is desirably set higher than a full-color toner image formed from the toner T of the four colors (Y, M, C, and K) in order to improve image quality. As illustrated in FIGS. 5A and 5B, in a case where only white toner $T_W$ is used, for example, a toner amount per unit area (TMA) is set to 8 (g/m$^2$) or more, specifically, approximately 8 (g/m$^2$) to 12 (g/m$^2$) forming approximately three toner layers that is larger than a toner amount of a single layer that is an image of a maximum density using the full-color toner T (Y, M, C, and K).

As described above, in the image forming apparatus 1, in a case where an image such as an independent white image is formed, a toner amount of the independent white image on the recording medium 5 is desirably set larger than a toner amount of an image of other colors, i.e., yellow (Y), magenta (M), cyan (C), and black (K) in order to increase a concealing ratio, a degree of whiteness, and the like of the recording medium 5.

Figure 6A:
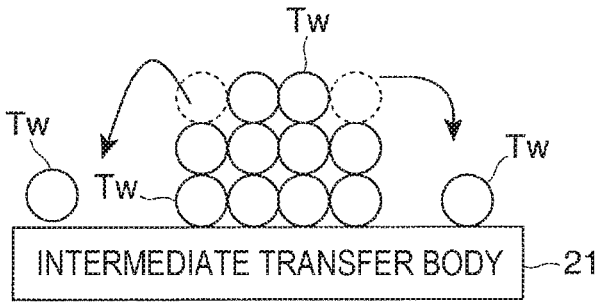
FIGS. 6A through 6D are configuration views illustrating a white toner image formed on an intermediate transfer belt in the image forming apparatus according to the first exemplary embodiment of the present invention.

However, research conducted by inventors of the present invention et al. revealed that in a case where a toner amount of an independent white image is set relatively large, white toner $T_W$ in a topmost layer of the white toner $T_W$ that has been first-transferred onto the intermediate transfer belt 21 is scattered due to electrostatic repulsion force acting between the toner, that is, a phenomenon called blur occurs and there is a risk of a degradation of image quality when the white toner image is first-transferred onto the intermediate transfer belt 21 from the photoconductor drum 11W in the image preparing device 10W for white (W), as illustrated in FIG. 6A.

Figure 6B:
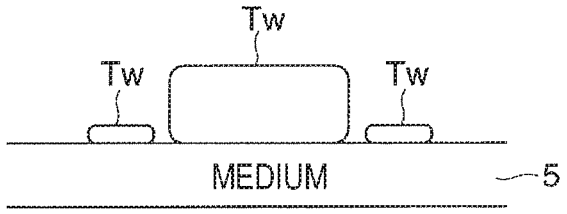

As illustrated in FIG. 6B, white toner $T_W$ scattered on the intermediate transfer belt 21 is scattered around an original image when finally second-transferred and fixed onto the recording paper 5, as illustrated in FIG. 6B. Therefore, the scattered white toner $T_W$ is visually recognized. This degrades image quality.

Figure 6C:
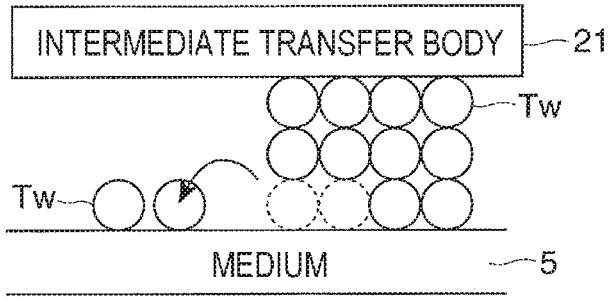

Furthermore, the research conducted by the inventors of the present invention et al. revealed that in a case where a toner amount of an independent white image is set relatively large, an image (especially a line image) made of white toner $T_W$ in the topmost layer on the intermediate transfer belt 21 is scattered on a downstream side along the direction in which the intermediate transfer belt 21 moves, i.e., a phenomenon called line skip occurs due to a rapid change in nip pressure at a time of second transfer and there is a risk of a degradation of image quality when a toner image formed from the white toner $T_W$ first-transferred onto the intermediate transfer belt 21 is second-transferred onto the recording paper 5, as illustrated in FIG. 6C.

Figure 6D:
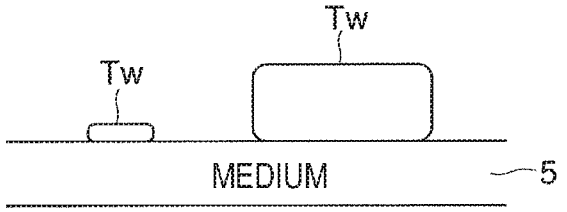

As in the case of blur, the white toner $T_W$ scattered due to line skip on the recording paper 5 is scattered around an original image when fixed, as illustrated in FIG. 6D. Therefore, the scattered white toner $T_W$ is visually recognized. This degrades image quality.

Configuration of Characteristic Part of Image Forming Apparatus

In view of the above circumstances, the image forming apparatus 1 according to the first exemplary embodiment has an image disturbance suppression mode in order to suppress occurrence of degradation in image quality caused, for example, by scattering of a toner image formed from the white toner $T_W$ that occurs as a result of first transfer and line skip of a toner image formed from the white toner $T_W$ that occurs as a result of second transfer. This image disturbance suppression mode is a mode in which in a case where an independent image formed from white toner is formed on the recording paper 5, the control device 100 that is an example of a setting unit sets an order of images that are transferred onto the intermediate transfer belt 21 so that an image formed from another kind of toner is transferred on the independent image formed from white toner transferred onto the intermediate transfer belt 21. Note that an independent image formed from white toner need not be formed on the whole recording paper 5. Instead, an independent image formed from white toner may be formed on a part of the recording paper 5, and a full-color image, a monochromatic image, or the like may be formed on the other part of the recording paper 5.

Figure 7A:
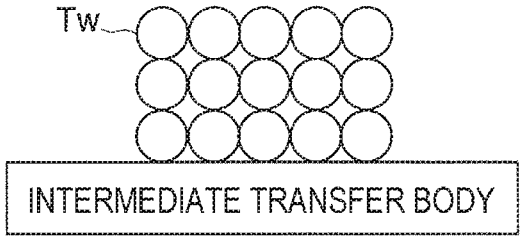
FIGS. 7A and 7B are configuration views illustrating a white toner image formed on the intermediate transfer belt in the image forming apparatus according to the first exemplary embodiment of the present invention.
Figure 7B:
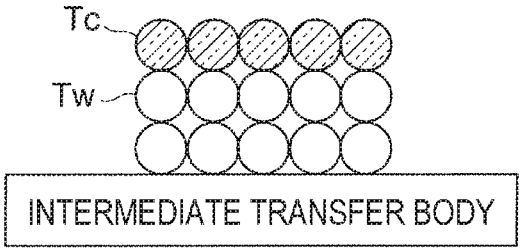

The image forming apparatus 1 includes the control device 100 that sets, in a case where the image disturbance suppression mode is selected, for example, by using a user interface of the control device 100, an order of images that are first-transferred onto the intermediate transfer belt 21 so that an image formed from another kind of toner is formed on an independent image formed from the white toner $T_W$ transferred onto the intermediate transfer belt 21 as illustrated in FIG. 7B instead of transferring the independent image formed from the white toner $T_W$ on the intermediate transfer belt 21 as illustrated in FIG. 7A even in a case where the independent image formed from the white toner $T_W$ is formed on the recording medium 5. In this first exemplary embodiment, transparent toner (T) contained in the image preparing device 10#1 for the spot color toner is used as the other kind of toner. The transparent toner (T) is first-transferred so as to overlap an image region identical to an image region of the white toner $T_W$ on the basis of image data identical to image data for the white toner $T_W$. Note that the other kind of toner is not limited to the transparent toner (T) contained in the image preparing device 10#1 for the spot color toner.

In other words, although an image density (pile height) of a whole image formed from the white toner $T_W$ is set high, specifically, approximately 8 (g/m$^2$) to 12 (g/m$^2$) in a case where an image formed from the white toner $T_W$ is formed on the recording medium 5 as illustrated in FIG. 7A, the image forming apparatus 1 according to this exemplary embodiment forms a toner image formed from another kind of toner (the transparent toner $T_C$ in the illustrated example) other than the white toner $T_W$ in at least a topmost layer of a toner image on the intermediate transfer belt 21 even in a case where an independent image formed from the white toner $T_W$ is formed on the recording medium 5. Accordingly, in this exemplary embodiment, a toner amount of a toner image formed from the white toner $T_W$ is set to approximately 6 (g/m$^2$), which is smaller than 8 (g/m$^2$) to 12 (g/m$^2$), as illustrated in FIG. 7B.

Figure 8A:
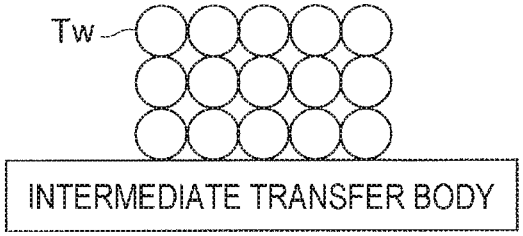
FIGS. 8A and 8B are configuration views illustrating a white toner image formed on the intermediate transfer belt in the image forming apparatus according to the first exemplary embodiment of the present invention.
Figure 8B:
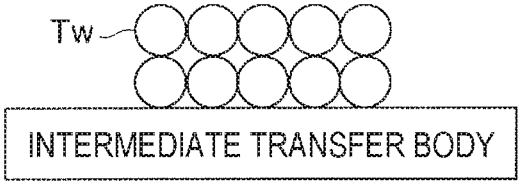

That is, in the image forming apparatus 1 according to the first exemplary embodiment, in a case where the image disturbance suppression mode for a white toner image is selected, for example, by using the user interface of the control device 100, the control device 100 sets a set density of an independent image formed from the white toner $T_W$ formed by the image preparing device 10W for white (W) to approximately 6 (g/m$^2$) that is a second value smaller than 8 (g/m$^2$) to 12 (g/m$^2$) that is a relatively high first value, as illustrated in FIGS. 8A and 8B.

Furthermore, as illustrated in FIG. 7B, the control device 100 first-transfers, at a density of a general solid image, an approximately one toner layer of a toner image formed from the transparent toner $T_C$ formed by the image preparing device 10#1 for the spot color (#1) onto a topmost layer of the image formed from the white toner $T_W$ on the intermediate transfer belt 21. The density of the toner image formed from the transparent toner $T_C$ is set, for example, to 100% but may be a lower value.

Figure 9:
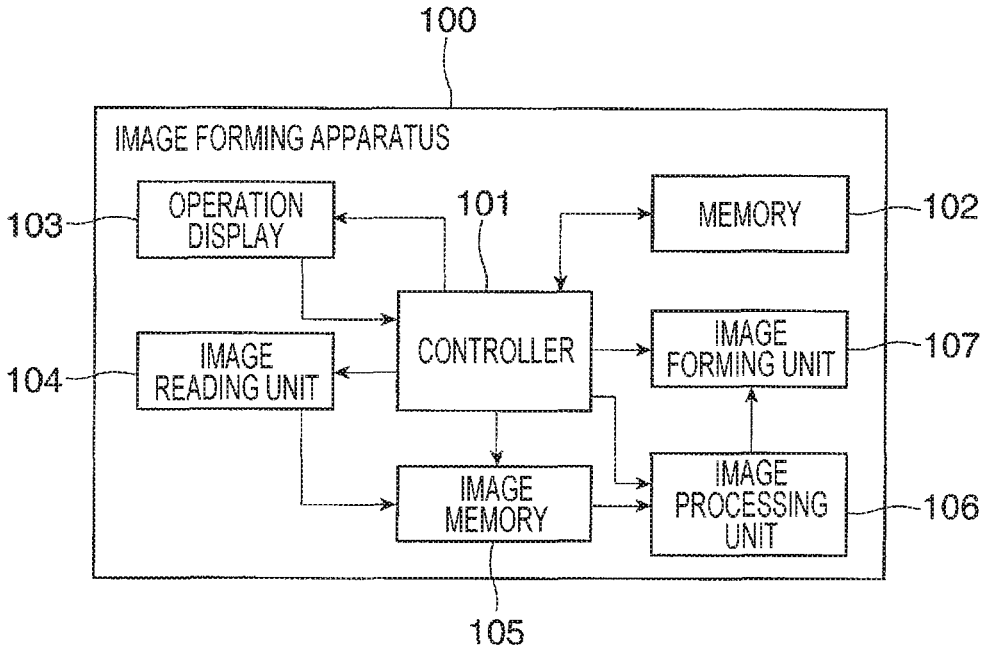
FIG. 9 is a block diagram illustrating a control device of the image forming apparatus according to the first exemplary embodiment of the present invention.

FIG. 9 is a block diagram illustrating the control device 100 of the image forming apparatus according to the present exemplary embodiment.

A controller 101 illustrated in FIG. 9 is a controller that collectively controls an operation of the whole image forming apparatus 1. A memory 102 is constituted by a ROM, a RAM, or the like in which a program, a parameter, a table, data, or the like for controlling an operation of the image forming apparatus 1 is recorded.

An operation display 103 is a display on which a user using the image forming apparatus 1 enters image formation conditions such as a size, the number of printed sheets of recording paper 5, and monochromatic/full-color and selects whether or not to execute the image disturbance suppression mode.

An image reading unit 104 reads an image of a document in a case where the image forming apparatus 1 functions as a color copying machine, an image memory 105 temporarily stores therein image information (data) read by the image reading unit 104 or externally supplied, an image processing unit 106 performs necessary image processing on image data stored in the image memory 105, and an image forming unit (printing unit) 107 performs an image forming (printing) operation on the basis of image data that has been subjected to the necessary processing in the image processing unit 106.

Operation of Characteristic Part of Image Forming Apparatus

In the image forming apparatus 1 according to the first exemplary embodiment, in a case where an independent image formed from white toner is formed as follows, degradation of image quality caused by scattering of the white toner is kept smaller than a case where only an independent image formed from the white toner is transferred onto the intermediate transfer body.

The image forming apparatus 1 determines whether or not the image disturbance suppression mode for the white toner has been selected, for example, by using the user interface of the control device 100. In a case where it is determined that the image disturbance suppression mode is not selected, the control device 100 performs a general image forming operation for forming an independent image formed from white toner.

Meanwhile, in a case where it is determined that the image disturbance suppression mode for the white toner has been selected, the control device 100 executes the following image disturbance suppression mode. The control device 100 sets a toner weight (g/m$^2$) per unit area of a toner image of a white independent image to approximately 6 (g/m$^2$) that is a second value smaller than 8 (g/m$^2$) to 12 (g/m$^2$) that is a first value used in a case where the image disturbance suppression mode is not selected and performs an image preparing operation in the image preparing device 10W for white (W) as illustrated in FIG. 10.

Figure 10:
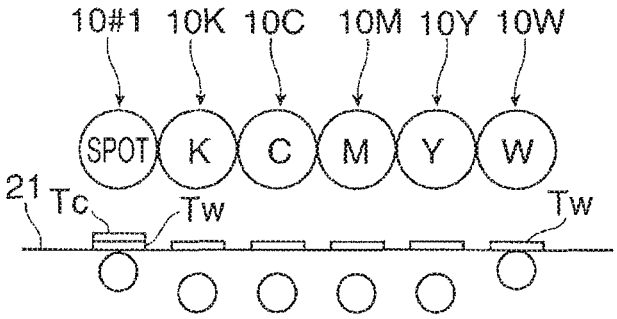
FIG. 10 illustrates an outline of an image forming step in the image forming apparatus according to the first exemplary embodiment of the present invention.

Next, the control device 100 forms an image formed from the transparent toner $T_C$ on the image formed from the white toner $T_W$ by using the transparent toner $T_C$ in the image preparing device 10#1 for the spot color (#1) as illustrated in FIG. 10.

Figure 11A:
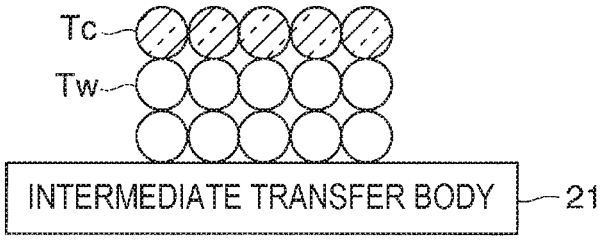
FIGS. 11A through 11C schematically illustrate a white toner image formed in the image forming apparatus according to the first exemplary embodiment of the present invention.

As a result, an image constituted by approximately two layers of toner images formed from the white toner $T_W$ is formed as lower layers on the intermediate transfer belt 21, and an image constituted by approximately one layer of toner image formed from the transparent toner $T_C$ is stacked as a topmost layer on the images formed from the white toner $T_W$, as illustrated in FIG. 11A.

Figure 11B:
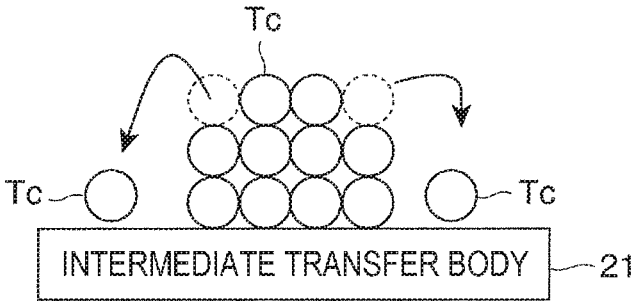

The toner image formed from the transparent toner $T_C$ in the topmost layer is first-transferred onto the toner images formed from the white toner $T_W$ in the lower layers so as to from multiple layers, and a total image density (pile height) of the toner image formed from the transparent toner $T_C$ combined with the white toner $T_W$ is higher than that of a general toner image. Accordingly, toner in the toner image formed from the transparent toner $T_C$ in the topmost layer is sometimes scattered due to electrostatic repulsion force between the toner as illustrated in FIG. 11B.

Figure 12A:
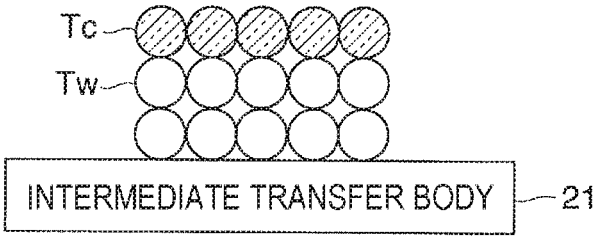
FIGS. 12A through 12C schematically illustrate a white toner image formed in the image forming apparatus according to the first exemplary embodiment of the present invention.
Figure 12B:
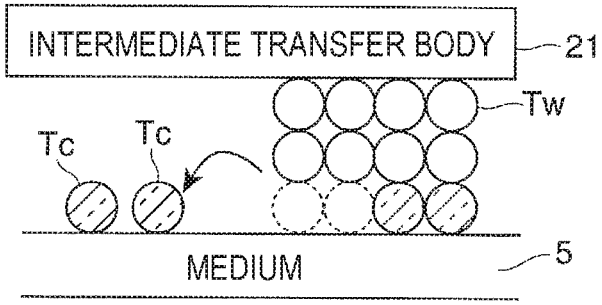

Finally, the toner images formed from the transparent toner $T_C$ and the white toner $T_W$ on the intermediate transfer belt 21 are collectively second-transferred onto the recording paper 5 at the second transfer position, and an image is formed through the fixing processing in the fixing device 40, as illustrated in FIGS. 12A and 12B. In this process, toner in the image (especially the line image) formed from the transparent toner $T_C$ in the topmost layer on the intermediate transfer belt 21 is scattered on a downstream side in the direction in which the intermediate transfer belt 21 moves, i.e., a phenomenon called line skip occurs due to a rapid change in nip pressure at the time of the second transfer, as illustrated in FIG. 11B.

Figure 11C:
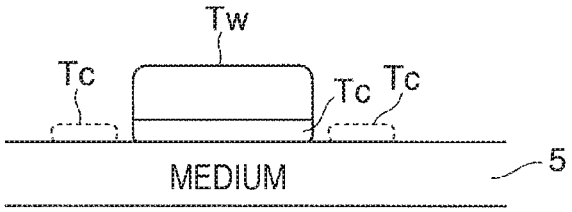
Figure 12C:
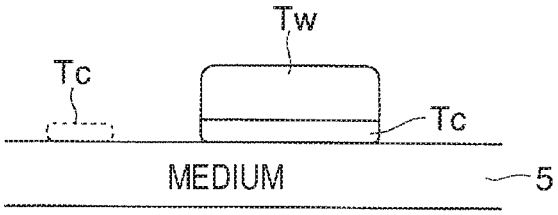

In this case, the toner images including the transparent toner $T_C$ as a lower layer and the white toner $T_W$ as upper layers are formed on the recording paper 5. The transparent toner $T_C$ that has been scattered is fixed around the toner images, as illustrated in FIGS. 11C and 12C. The toner scattered around the toner image formed from the white toner $T_W$ is the transparent toner $T_C$ and is therefore hard to observe visually. This suppresses or prevents degradation in image quality.

As described above, in the image forming apparatus 1 according to the first exemplary embodiment, an image formed from white toner having an increased total pile height is formed, as an image formed from the white toner $T_W$, on a toner image formed from the transparent toner $T_C$ in a lower layer. It is therefore possible to increase a degree of whiteness and a concealing ratio of the image formed from the white toner as in the case where an image density of white toner in an independent image formed from the white toner is increased. Furthermore, the toner image formed from the transparent toner $T_C$ is formed in a topmost layer on the image formed from white toner on the intermediate transfer belt 21. Accordingly, even in a case where the transparent toner $T_C$, which is transparent, in the topmost layer is scattered, the scattered transparent toner $T_C$ is hard to observe visually. This makes degradation in image quality such as blur less likely to occur, thereby improving image quality.

Similarly, although there is a risk of occurrence of scattering, such as line skip, of the transparent toner $T_C$ in the topmost layer of the toner images formed from the white toner and the transparent toner $T_C$ from the intermediate transfer belt 21 onto the recording paper 5 in the image forming apparatus 1 according to the first exemplary embodiment, the transparent toner $T_C$, which is transparent, is hard to observe visually, and therefore degradation in image quality such as line skip is less likely to occur and image quality improves, as described above.

Experimental Example 1

The inventors of the present invention experimentally produces a bench model of the image forming apparatus 1 illustrated in FIG. 1 and conducts an experiment for checking how much a degree of whiteness of toner images formed from white toner and the transparent toner $T_C$ on the recording paper 5 is improved in order to confirm the effects of the image forming apparatus 1 according to the first exemplary embodiment. In this experiment, Kisyu black paper is used as the recording paper 5. Furthermore, a degree of whiteness in a case where a toner image formed only from the white toner $T_W$ is formed by the image preparing device 10W for white (W) is measured in Comparative Example 1, and a degree of whiteness in a case where the white toner $T_W$ is used in the image preparing device 10#1 for the spot color (#1) and a toner image is formed only from the white toner $T_W$ by the image preparing device 10#1 for the spot color (#1) is measured in Comparative Example 2.

Figure 13:
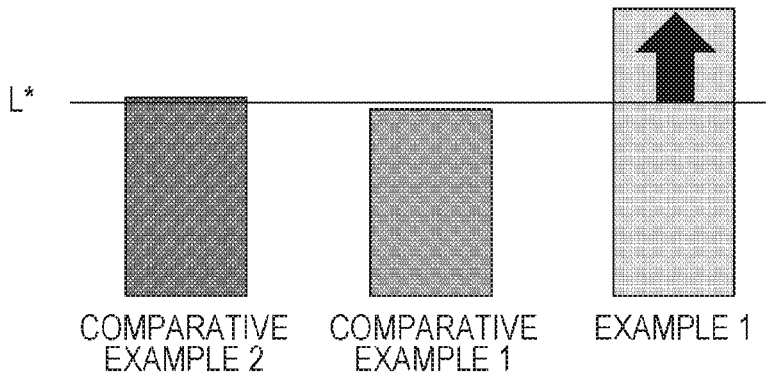
FIG. 13 is a graph illustrating a result of experimental example 1.

FIG. 13 is a graph illustrating results of Experimental Example 1 and Comparative Examples 1 and 2.

As is clear from FIG. 13, a degree of whiteness of a white independent image formed only from the white toner $T_W$ improves as compared with Comparative Examples 1 and 2.

Experimental Example 2

The inventors of the present invention experimentally produces a bench model of the image forming apparatus 1 illustrated in FIG. 1 and conducts an experiment for checking how much density unevenness of a low frequency called "mottle" occurs due to scattering of white toner in toner images formed from the white toner and the transparent toner $T_C$ in order to confirm the effects of the image forming apparatus 1 according to the first exemplary embodiment. In this experiment, Kisyu black paper is used as the recording paper 5. Furthermore, a toner image formed only from the white toner $T_W$ is formed by the image preparing device 10W for white (W) in Comparative Example 3.

Figure 14:
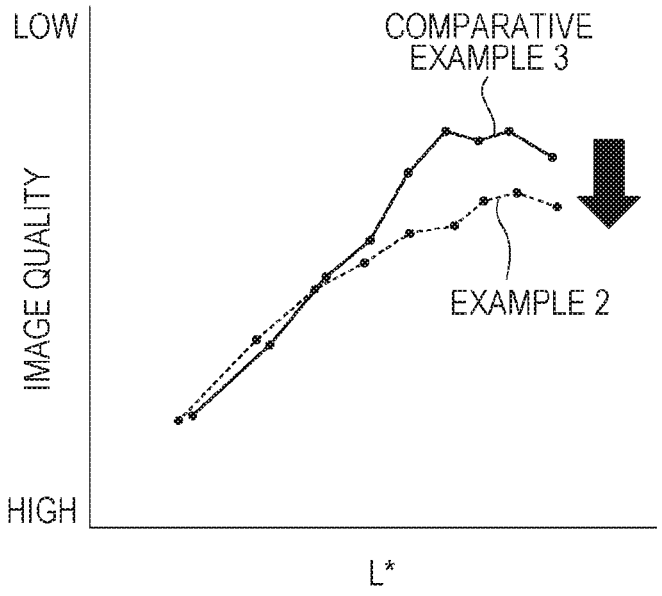
FIG. 14 is a graph illustrating a result of experimental example 2.

FIG. 14 is a graph illustrating results of experimental example 2 and Comparative Example 3.

As is clear from FIG. 14, in Experimental Example 2, the density unevenness of the low frequency called "mottle" decreases, i.e., improves in a case where a degree of whiteness is improved by increasing a toner amount of the white toner $T_W$, as compared with Comparative Example 3.

This is considered to be because the transparent toner $T_C$ is hard to observe visually although the transparent toner $T_C$ in a topmost layer on the intermediate transfer belt 21 is scattered and because disarray of the white toner $T_W$ caused by scattering of the transparent toner $T_C$ is hard to occur since a particle diameter of the transparent toner $T_C$ in a lowermost layer on the recording paper 5 is smaller than the white toner $T_W$.

Second Exemplary Embodiment

Figure 15A:
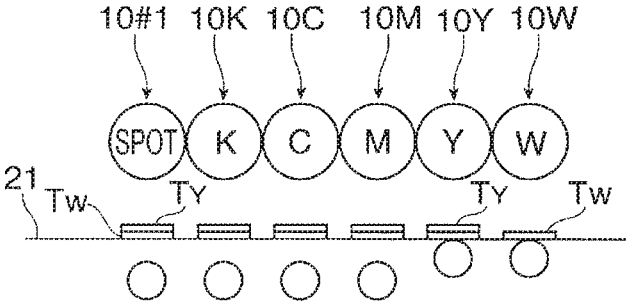
FIGS. 15A and 15B schematically illustrate an image forming step in an image forming apparatus according to a second exemplary embodiment of the present invention.
Figure 15B:
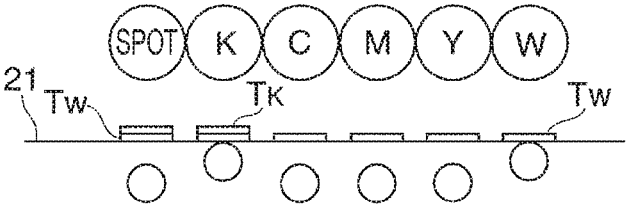

FIGS. 15A and 15B illustrate an image forming apparatus according to a second exemplary embodiment.

In the image forming apparatus 1 according to the second exemplary embodiment, toner that is less noticeable than white toner when transferred onto recording paper 5 is used as another kind of toner. For example, the image forming apparatus 1 is configured to use, as the other kind of toner, yellow (Y) toner that is toner less noticeable than white toner when transferred onto the recording paper 5, as illustrated in FIG. 15A. The yellow (Y) toner is less noticeable than white toner on the recording paper 5 of a color (e.g., black) other than white. In this case, a yellow (Y) toner image is formed by an image preparing device 10Y for yellow (Y) on the basis of image data identical to image data for an image preparing device 10W for white (W).

In the image forming apparatus 1 according to the second exemplary embodiment, in a case where black recording paper is used as the recording paper 5, black (K) toner having a color identical to the color of the recording paper 5 is used as the other kind of toner, as illustrated in FIG. 15B. In this case, a black (K) toner image is formed by an image preparing device 10K for black (K) on the basis of image data identical to image data for the image preparing device 10W for white (W).

Third Exemplary Embodiment

Figure 16:
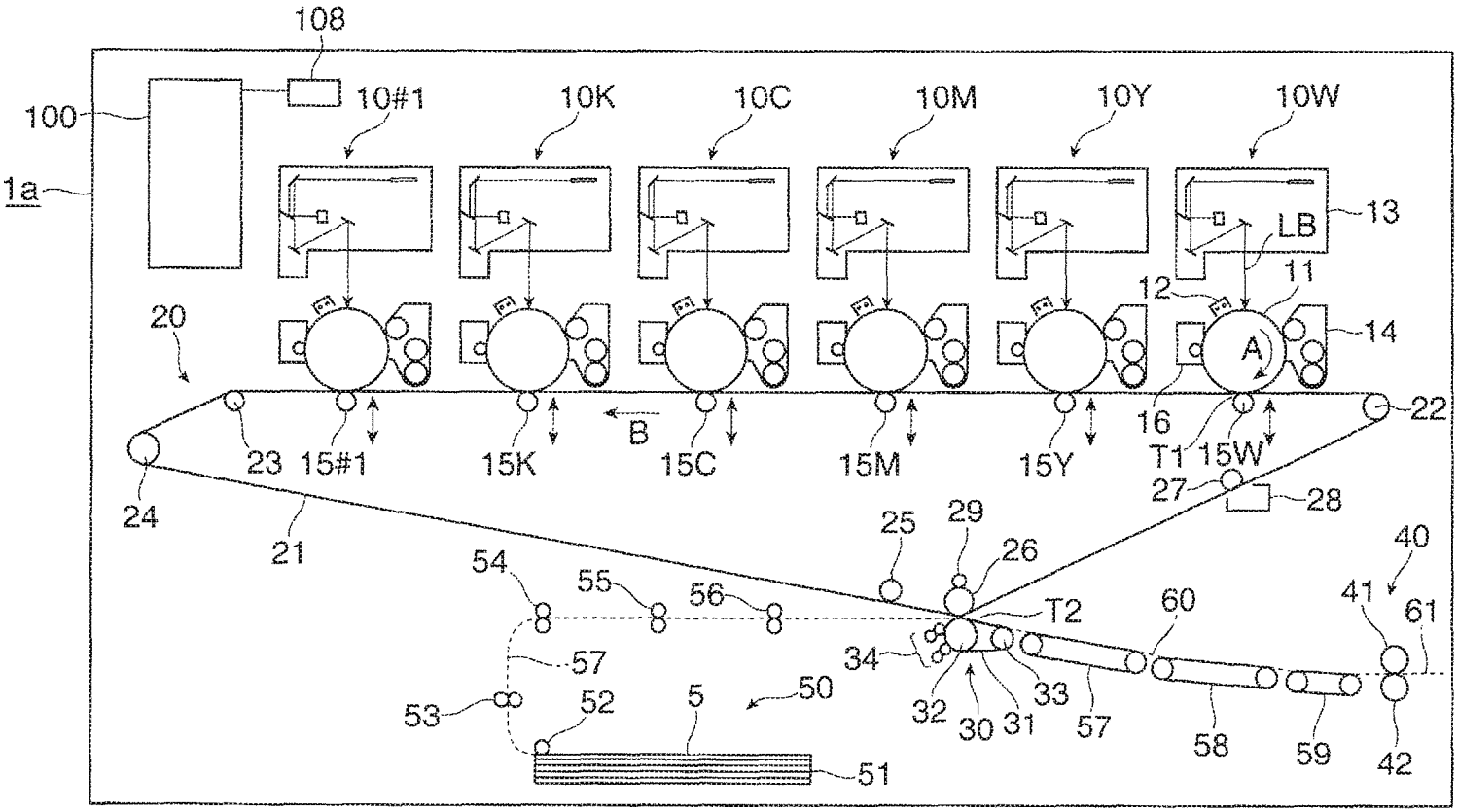
FIG. 16 illustrates an outline configuration of an image forming apparatus according to a third exemplary embodiment of the present invention.

FIG. 16 illustrates an image forming apparatus according to a third exemplary embodiment.

As illustrated in FIG. 16, the image forming apparatus 1 according to the third exemplary embodiment includes an environment sensor 108 that is an example of an environment detecting unit that detects at least one of temperature and humidity of an environment in which the image forming apparatus 1 is placed.

Research conducted by the inventors of the present invention reveals that degradation in image quality called blur is likely to occur at low temperature and low humidity, and degradation in image quality called line skip is likely to occur at high temperature and high humidity.

In view of this, in the image forming apparatus 1 according to the third exemplary embodiment, the environment sensor 108 detects temperature and humidity in the environment in which the image forming apparatus 1 is placed, and a control device 100 determines whether or not to execute an image disturbance suppression mode for a white toner image in accordance with environment conditions, i.e., the temperature and humidity detected by the environment sensor 108.

In a case where it is determined that the temperature and humidity detected by the environment sensor 108 in the environment in which the image forming apparatus 1 is placed are typical temperature and humidity, the control device 100 forms an independent image formed from white toner under a general image forming condition without executing the image disturbance suppression mode for a white toner image.

Meanwhile, in a case where it is determined that the temperature and humidity detected by the environment sensor 108 in the environment in which the image forming apparatus 1 is placed are low temperature and low humidity or high temperature and high humidity, the control device 100 executes the image disturbance suppression mode for a white toner image.

Fourth Exemplary Embodiment

Figure 17A:
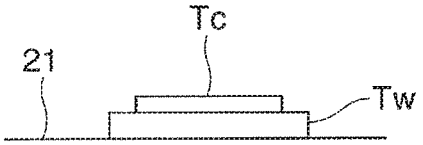
FIGS. 17A and 17B schematically illustrate a white toner image formed in an image forming apparatus according to a fourth exemplary embodiment of the present invention.
Figure 17B:
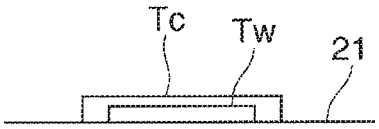

FIGS. 17A and 17B illustrate an image formed by an image forming apparatus according to a fourth exemplary embodiment.

In the image forming apparatus 1 according to the first exemplary embodiment, a toner image formed from white toner is identical to a toner image formed from transparent toner that is another kind of toner, as illustrated in FIG. 7B.

In the image forming apparatus 1 according to the fourth exemplary embodiment, a toner image formed from white toner $T_W$ and a toner image formed from transparent toner $T_C$ that is another kind of toner are different in size (area), as illustrated in FIGS. 17A and 17B.

For example, in the image forming apparatus 1 according to the fourth exemplary embodiment, an area of a toner image formed from transparent toner that is another kind of toner is set smaller than an area of a toner image formed from white toner on an intermediate transfer belt 21 as illustrated in FIG. 17A or an area of a toner image formed from transparent toner that is another kind of toner is set larger than an area of a toner image formed from white toner on the intermediate transfer belt 21 as illustrated in FIG. 17B.

In this case, image data that has been corrected through image processing in a control device 100 so that the area of the toner image formed from the transparent toner becomes larger than the area of the toner image formed from the white toner is used as image data for formation of an image in an image preparing device for a spot color using the transparent toner. The corrected image data is created by interpolation, specifically, addition or deletion of a predetermined number of pixels around image data for the white toner.

In the fourth exemplary embodiment, even in a case where the transparent toner that is the other kind of toner is scattered on the intermediate transfer belt 21, the scattered transparent toner falls within a region of the toner image of the white toner in a lower layer or occurrence of scattering itself of the transparent toner that is the other kind of toner can be suppressed, as illustrated in FIGS. 17A and 17B. This improves image quality.

In the exemplary embodiments, a tandem system image forming apparatus including plural image preparing devices has been described, but the present invention is not limited to this. Needless to say, the present invention may be applied to an N-cycle image forming apparatus that includes plural developing devices and repeats a process for sequentially first-transferring toner images of different colors on an intermediate transfer body a predetermined number of times (N times).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first image forming unit configured to form a first image by using first toner;

a second image forming unit configured to form a second image by using a second kind of toner different from the first toner;

a transfer unit configured to transfer the first image and the second image onto an intermediate transfer body and then onto a recording medium; and a setting unit configured to, in response to a determination that an independent image formed from the first toner is to be formed on the recording medium, control the transfer unit so that the second image is transferred onto the independent image formed from the first toner that has been transferred onto the intermediate transfer body.

2. The image forming apparatus according to claim 1, wherein the setting unit is configured to, only in response to a determination that a toner amount per unit area of the independent image formed from the first toner is equal to or larger than a threshold value, control the transfer unit so that the second image is transferred onto the independent image formed from the first toner.

3. The image forming apparatus according to claim 2, wherein the threshold value is approximately 8 $g/m^2$ or more.

4. The image forming apparatus according to claim 1, wherein the setting unit is configured to, only in response to a determination that a number of toner layers of the independent image formed from the first toner is equal to or larger than a threshold value, control the transfer unit so that the second image is transferred onto the independent image formed from the first toner.

5. The image forming apparatus according to claim 4, wherein the threshold value is a number of layers larger than approximately one layer.

6. The image forming apparatus according to claim 1, wherein the intermediate transfer body includes an intermediate transfer belt; and wherein the first image forming unit is disposed on an upstream side relative to the second image forming unit along a direction in which the intermediate transfer belt moves.

7. The image forming apparatus according to claim 2, wherein the intermediate transfer body includes an intermediate transfer belt; and wherein the first image forming unit is disposed on an upstream side relative to the second image forming unit along a direction in which the intermediate transfer belt moves.

8. The image forming apparatus according to claim 3, wherein the intermediate transfer body includes an intermediate transfer belt; and wherein the first image forming unit is disposed on an upstream side relative to the second image forming unit along a direction in which the intermediate transfer belt moves.

9. The image forming apparatus according to claim 4, wherein the intermediate transfer body includes an intermediate transfer belt; and wherein the first image forming unit is disposed on an upstream side relative to the second image forming unit along a direction in which the intermediate transfer belt moves.

10. The image forming apparatus according to claim 5, wherein the intermediate transfer body includes an intermediate transfer belt; and wherein the first image forming unit is disposed on an upstream side relative to the second image forming unit along a direction in which the intermediate transfer belt moves.

11. The image forming apparatus according to claim 6, wherein the first image forming unit is disposed on a most upstream side along the direction in which the intermediate transfer belt moves.

12. The image forming apparatus according to claim 7, wherein the first image forming unit is disposed on a most upstream side along the direction in which the intermediate transfer belt moves.

13. The image forming apparatus according to claim 8, wherein the first image forming unit is disposed on a most upstream side along the direction in which the intermediate transfer belt moves.

14. The image forming apparatus according to claim 9, wherein the first image forming unit is disposed on a most upstream side along the direction in which the intermediate transfer belt moves.

15. The image forming apparatus according to claim 10, wherein the first image forming unit is disposed on a most upstream side along the direction in which the intermediate transfer belt moves.

16. The image forming apparatus according to claim 1, wherein the second kind of toner is toner that is less noticeable than the first toner when transferred onto the recording medium.

17. The image forming apparatus according to claim 16, wherein the second kind of toner is toner that has a color identical to the recording medium or is a transparent toner.

18. An image forming apparatus comprising:

a first image forming means for forming a first image by using first toner;

a second image forming means for forming a second image by using a second kind of toner different from the first toner;

a transfer means for transferring the first image and the second image onto an intermediate transfer body and then onto a recording medium; and a setting means for, in response to a determination that an independent image formed from the first toner is to be formed on the recording medium, controlling the transfer means so that the second image is transferred onto the independent image formed from the first toner that has been transferred onto the intermediate transfer body.

19. The image forming apparatus according to claim 1, wherein the first toner comprises white toner, and wherein the second toner comprises at least one of a metallic color toner, a transparent toner, and a foamed toner.

20. The image forming apparatus according to claim 19, wherein the second toner comprises a transparent toner.

* * * * *